US011008989B2

(12) United States Patent
Serra et al.

(10) Patent No.: US 11,008,989 B2
(45) Date of Patent: May 18, 2021

(54) FUEL RAIL ASSEMBLY

(71) Applicant: CPT Group GmbH, Hannover (DE)

(72) Inventors: Giandomenico Serra, Ghezzano-S.Giuliano Terme (IT); Gisella Di Domizio, San Giuliano Terme (IT); Ivo Lorenz, Chemnitz (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 16/337,152

(22) PCT Filed: Sep. 28, 2017

(86) PCT No.: PCT/EP2017/074667
§ 371 (c)(1),
(2) Date: Mar. 27, 2019

(87) PCT Pub. No.: WO2018/060353
PCT Pub. Date: Apr. 5, 2018

(65) Prior Publication Data

US 2020/0032750 A1 Jan. 30, 2020

(30) Foreign Application Priority Data

Sep. 30, 2016 (EP) ..... 16191698

(51) Int. Cl.
*F02M 55/02* (2006.01)
*F02M 55/00* (2006.01)

(52) U.S. Cl.
CPC ..... *F02M 55/025* (2013.01); *F02M 55/005* (2013.01); *F02M 2200/315* (2013.01)

(58) Field of Classification Search
CPC ..... F02M 55/025
See application file for complete search history.

(56) References Cited

U.S. PATENT DOCUMENTS 6,213,095 B1 4/2001 Asada et al. ..... 123/456
6,886,537 B2 * 5/2005 Kondo ..... F02M 55/005 123/456

(Continued)

FOREIGN PATENT DOCUMENTS

CN 1193690 A 9/1998 ..... B21C 37/29
CN 203285591 U 11/2013 ..... F02M 55/02

(Continued)

OTHER PUBLICATIONS

Volkmer, DE 102005044276, machine translation (Year: 2007).*

(Continued)

*Primary Examiner* — Hung Q Nguyen
*Assistant Examiner* — Mark L. Greene
(74) *Attorney, Agent, or Firm* — Slayden Grubert Beard PLLC

(57) ABSTRACT

Various embodiments include a fuel rail assembly for an internal combustion engine comprising: an elongate, common fuel rail having a reservoir for a fuel supply; a plurality of adapters spaced along and fixed to a wall of the fuel rail for hydraulically connecting a respective fuel injector to the reservoir in the common rail; and a respective fuel passage associated with each adapter of the plurality of adapters, each fuel passage directing fuel from the reservoir to the associated adapter. Each fuel passage comprises an inlet end open to the reservoir and an upstream end section adjacent to the inlet end having a length and a cross-sectional area forming a smoothing function to smooth pressure fluctuations in the fuel entering the respective passage.

13 Claims, 1 Drawing Sheet

(56) References Cited

U.S. PATENT DOCUMENTS

| | | | | |
|---|---|---|---|---|
| 2009/0179421 | A1 | 7/2009 | Stieler et al. | 285/148.19 |
| 2010/0012091 | A1 | 1/2010 | Kaman et al. | 123/447 |
| 2017/0226978 | A1 | 8/2017 | Soma et al. | |

FOREIGN PATENT DOCUMENTS

| | | | | | |
|---|---|---|---|---|---|
| DE | 101 43 511 | A1 | | 3/2003 | F02M 55/02 |
| DE | 10 2004 037 787 | A1 | | 2/2006 | F02M 55/02 |
| DE | 102005044276 | A1 | * | 3/2007 | F16L 41/084 |
| EP | 3232046 | A1 | * | 10/2017 | F02M 55/025 |
| FR | 2756609 | A1 | * | 6/1998 | F16L 41/12 |
| JP | 08277764 | A | | 10/1996 | F02M 47/00 |
| JP | 2014-088791 | A | | 5/2014 | F02M 55/02 |
| WO | 2016/063640 | A1 | | 4/2016 | F02M 55/02 |
| WO | 2018/060353 | A1 | | 4/2018 | F02M 55/00 |

OTHER PUBLICATIONS

Hitachi, FR 2756609, machine translation (Year: 1998).*
Extended European Search Report, Application No. 16191698.6, 7 pages, dated Mar. 30, 2017.
International Search Report and Written Opinion, Application No. PCT/EP2017/074667, 11 pages, dated Jan. 8, 2018.
Chinese Office Action, Application No. 201780060755.2, 19 pages, dated Jul. 29, 2020.
Korean Office Action, Application No. 20197012416, 10 pages, dated Mar. 11, 2020.

* cited by examiner

FUEL RAIL ASSEMBLY

CROSS-REFERENCE TO RELATED APPLICATIONS

This application is a U.S. National Stage Application of International Application No. PCT/EP2017/074667 filed Sep. 28, 2017, which designates the United States of America, and claims priority to EP Application No. 16191698.6 filed Sep. 30, 2016, the contents of which are hereby incorporated by reference in their entirety.

TECHNICAL FIELD

The present disclosure relates to internal combustion engines. Various embodiments may include fuel rail assemblies for a fuel injection assembly for an internal combustion engine, particularly but not exclusively, for a gasoline direct injection internal combustion engine.

BACKGROUND

Fuel injection assemblies are widely used for injecting fuel into an internal combustion engine, particularly but not exclusively having a fuel injector for each cylinder of a multi-cylinder engine, in which the fuel is supplied from a reservoir in the form of a common rail to which each of the fuel injectors is hydraulically connected. The fuel injectors may inject the fuel into an inlet manifold or directly into the cylinder. In typical assemblies, the fuel injector is located in a fuel injector cup. Often, the fuel injectors and/or the injector cups are connected to the fuel rail via an intermediate component such as a fuel delivery pipe but because of space restrictions in the installation of the engine and the need to reduce the cost and complexity of the fuel injection system, some assemblies secure the injector cups directly to the fuel rail without any intermediate component.

Although such an arrangement may have advantages, it does have at least one problem in as much as the fuel pressure oscillations which occur in a common rail during operation are transmitted directly into the fuel injector cup where they have an adverse effect on fuel injector functionality and efficiency. In the prior art, these oscillations are to a great extent smoothed out by the length of the passage formed by the intermediate component or fuel pipe between the common rail and the fuel injector or the injector cup.

SUMMARY

The teachings of present disclosure describe arrangements which minimize the transmission of pressure oscillations in the common rail to the fuel injector. For example, some embodiments include a fuel rail assembly for an internal combustion engine comprising: an elongate, common fuel rail (2) forming a reservoir (4) for a fuel supply, a plurality of adapters spaced along and fixed to a wall (3) of the fuel rail (2) for hydraulically connecting an associated fuel injector to the reservoir (4) in the common rail (2), and a fuel passage (12) associated with each adapter and operable to lead fuel from the reservoir (4) to the respective adapter, wherein each fuel passage (12) comprises an inlet end (8) open to the reservoir (4) and has an upstream end section (14) adjacent to the inlet end (8) having a predetermined length (L2) and a predetermined cross-sectional area such as to form a smoothing function to smooth pressure fluctuations in the fuel entering the passage (12).

In some embodiments, each fuel passage (12) is formed by a through-hole in the wall (3) of the fuel rail (2).

In some embodiments, each adapter comprises or consists of an injector cup (6) adapted to receive an inlet end of a fuel injector, the injector cup (6) being mechanically secured to the wall (3) of the fuel rail (2) and having an orifice (10) hydraulically connected to a downstream end of the fuel passage (12), remote from the inlet end (8).

In some embodiments, the fuel passage (12) is configured to accommodate a ring of brazing material (18) at its periphery through which ring of brazing material (18) the injector cup (6) is brazed to the fuel rail (2).

In some embodiments, the fuel passage (12) has a downstream end section (16) adjacent to the adapter which has a larger cross-sectional area than the cross-sectional area of the upstream end section (14).

In some embodiments, the fuel passage comprises a frusto-conical section (28) expanding from the upstream end section (14) to the downstream end section (16). In some embodiments, the frusto-conical section (28) is provided with a surface profile or roughness configured to control the flow of brazing material thereacross during a brazing process.

In some embodiments, the upstream end section (14) and the downstream end section (16) are generally cylindrical, the downstream end section (16) comprising a generally cylindrical part having a larger diameter than the upstream end section (14), and wherein the fuel passage (12) has a radially extending wall (26) perpendicular to the axis (20) of the upstream end section (14) and connecting a downstream end of the upstream end section (14) with an upstream end of the downstream end section (16). In some embodiments, the radially extending wall (26) has an annular channel (24) configured to provide a relief channel to absorb excess brazing material during a brazing process for fixing the adapter to the wall (3) of the fuel rail (2). In some embodiments, the radially extending wall (26) has a plurality of concentrically disposed annular channels (24).

In some embodiments, the radially extending wall (26) is provided with a surface profile or roughness configured to control the flow of brazing material during a brazing process.

In some embodiments, the thickness of the wall (3) in the region of each fuel passage (12) is such as to provide the length required for the fuel passage (12). In some embodiments, the wall (3) is generally cylindrical and has at least one flattening (5) comprising the fuel passages (12).

In some embodiments, the upstream end section (14) of the fuel passage (12) is chamfered or curved at its upstream end and/or at its downstream end.

BRIEF DESCRIPTION OF THE DRAWINGS

Example embodiments of the fuel rail assembly are described by way of example with reference to the accompanying drawings, in which.

DETAILED DESCRIPTION

Figure 1:
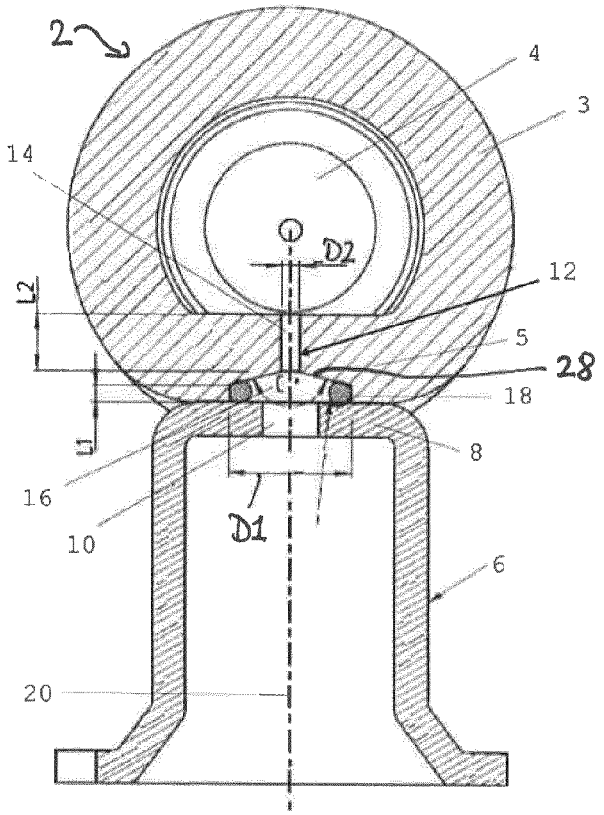
FIG. 1 shows a cross-sectional view of a fuel rail and a fuel injector cup showing a fuel passage incorporating teachings of the present disclosure.

In some embodiments, a fuel rail assembly for an internal combustion engine comprises an elongate, common fuel rail forming a reservoir for a fuel supply. The assembly may comprise a plurality of adapters. The adapters are spaced along the fuel rail for hydraulically connecting an associated fuel injector to the fuel reservoir in the common rail. The adapters may be fixed to a wall of the fuel rail and may adjoin the wall.

In some embodiments, the fuel rail assembly further comprises a plurality of fuel passages, in particular so that a respective fuel passage is associated with each adapter. The fuel passages may be operable to lead fuel from the reservoir to the respective adapter. In some embodiments, each fuel passage is formed by a through-hole in the wall of the fuel rail.

In some embodiments, each fuel passage comprises an inlet end open to the common fuel rail and has an upstream end section having a predetermined length and a predetermined cross-sectional area, in particular such as to form a smoothing function to smooth pressure fluctuations in the fuel entering the passage. In some embodiments, the length of the upstream end section is at least twice as large as a maximum diameter of the upstream end section. In some embodiments, the length of the upstream end section has a value of at least one third, in particular at least half or even at least two thirds of the length of the fuel passage. In some embodiments, the length and small diameter of the upstream end section serve to smooth out the oscillations in pressure in the fuel passing from the common rail into the fuel passage prior to it reaching the fuel injector.

In some embodiments, each adapter comprises an injector cup or consists of the injector cup. The injector cup may be configured to receive an inlet end of the respective associated fuel injector. In some embodiments, the injector cup is mechanically secured to the wall of the fuel rail, in particular such that it adjoins the wall. The opening may comprise an orifice perforating a closed upper end of the injector cup, the closed upper end being positioned opposite of a lower end of the injector cup through which the fuel injector is insertable into the cup.

In some embodiments, the injector cup has an opening which is hydraulically connected to a downstream end of the fuel passage. In some embodiments, the opening represents an interface from the fuel passage into an interior of the injector cup, e.g. adjoining both of them. In some embodiments, the subject assembly facilitates at the same time the possibilities of directly connecting the injector cup to the fuel rail, of achieving adequate damping of pressure pulsations and of forming the injector cup by a pressing or deep drawing from sheet material, in particular instead of forming a pressure pulsation damping fluid passage by drilling a hole in an injector cup machined from solid material, which is inevitably much more costly.

In some embodiments, the fuel passage is configured to accommodate a ring of brazing material at its periphery through which the injector cup is brazed to the fuel rail. In this way, the connection between the fuel rail and the injector cup can be established in simple and reliable fashion.

In some embodiments, the fuel passage has a downstream end section having a larger cross-sectional area than the cross-sectional area of the upstream end section. This arrangement further enhances the smoothing effect of the fuel passage.

In some embodiments, the fuel passage is configured to accommodate the ring of brazing material in the downstream end section. The ring of brazing material may extend circumferentially around the upstream end section in top view of the downstream end of the fuel passage, in particular such that the brazing material does not overlap the downstream end of the upstream end section. In some embodiments, the risk of brazing material clogging the fuel passage—in particular in the region of the upstream end section—may, thus, be particularly small.

In some embodiments, the fuel passage comprises a frusto-conical section expanding from the upstream end section to the downstream end section. In other words, the downstream end section is connected to the upstream end section by a tapering interface section—in particular a conical tapering interface section—of the fuel passage. The frusto-conical section may have a surface profile or roughness to control the flow of the brazing material thereacross during the brazing process.

In some embodiments, the upstream end of the upstream end section and/or the downstream end of the upstream end section are chamfered or curved. This may control the flow and pressure oscillations of the fuel in the fuel passage.

In some embodiments, the fuel passage is cylindrical in cross-section and the downstream end section comprises a generally cylindrical part having a larger diameter than the upstream end section. To put it differently, the upstream end section and the downstream end section are generally cylindrical or at least comprise cylindrical parts with different diameters, the diameter of the downstream end section or its cylindrical part being larger than the diameter of the upstream end section or its cylindrical part.

In some embodiments, the fuel passage has a radially extending wall. The radially extending wall in particular represents an interface section of the fuel passage which the upstream end section and the downstream end section adjoin on opposite sides. In some embodiments, the radially extending wall forms the frusto-conical section. In some embodiments, the radially extending wall is at least generally perpendicular to a central axis of the upstream end section. In some embodiments, the radially extending wall has an annular channel. The annular channel may be configured to provide a relief channel to absorb excess brazing material during a brazing process, the brazing process in particular fixing the adapter to the wall of the fuel rail. In some embodiments, the annular channel may be positioned laterally between the ring of brazing material and the downstream end of the upstream end section, e.g. in top view of the downstream end of the fuel passage. In some embodiments, the radially extending wall has a plurality of concentrically disposed annular channels configured to provide relief channels to absorb excess brazing material. In this way, the risk of brazing material clogging the fuel passage—in particular in the region of the upstream end section—may be further reduced.

In some embodiments, the radially extending wall has a roughened or profiled surface to control the flow of brazing material during the brazing process. In other words, the radially extending wall—in particular extending perpendicular to the central axis of the upstream end section or forming the frusto-conical section—is provided with a surface profile or with a surface roughness which is configured to control—e.g. in particular to retard—flow of brazing material during the brazing process.

Referring now to FIG. 1 there is shown a cross-section of a common fuel rail 2 which comprises an elongate, generally tubular member formed of stainless steel which has a fuel inlet at one end and is closed at the other by an end plug. The viewing direction of FIG. 1 is along an elongation direction of the fuel rail 2. The interior of the fuel rail 2 is shaped by a circumferential wall 3 of the tubular member and forms a reservoir 4 for a high-pressure supply of fuel for a gasoline injection internal combustion engine, the reservoir being connected to a high-pressure fuel pump (not shown) via the fuel inlet.

Spaced along the length of the common rail there are a plurality of adapters—the adapters consisting of fuel injector cups 6 in the present embodiment. Only one of the injector cups 6 is visible in the cross-sectional view of FIG. 1. The injector cup 6 may be mechanically secured to the wall 3 of the fuel rail 2, e.g. by a brazing process. Each injector cup 6 comprises a generally cylindrical body open at its lower end 8 to receive the inlet end of a fuel injector (not shown). At its closed upper end where it is brazed to the fuel rail 2, the injector cup 6 has an orifice 10 to form a fluid communication with a fuel passage 12 in the wall of the common rail to provide a hydraulic fluid connection between the reservoir 4 in the common rail and the interior of the injector cup.

The fuel passage 12 is formed by a through-hole in a flattening 5 of the circumferential wall 3 of the fuel rail 2. The fuel rail assembly comprises one such through-hole for each injector cup 6. The thickness of the flattening 5—i.e. the wall part of the wall 3 of the fuel rail 2 containing the fuel passage 12—is dimensioned to provide the desired length of the fuel passage 12. This may be achieved by the common rail 2 being drawn with a constant cross-section throughout its length or may be achieved by a localised thickening of the wall part in the region of the fuel passage 12.

The fuel passage 12 extends through the wall 3 from an inlet end 8 to a downstream end, remote from the inlet end. The inlet end 8 is represented by an opening of the fuel passage 12 into the reservoir 4 which is comprised by an internal surface of the wall 3. The downstream end is represented by an opening in an external surface of the wall 3 which faces away from the reservoir 4.

The fuel passage 12 consists of an upstream end section 14, a downstream end section 16 and a frusto-conical interface section 28 connecting the upstream end section 14 to the downstream end section 16. The upstream end section is a cylindrical bore in this embodiment. It has a predetermined length L2 and a relatively small cross-sectional area, defined by the diameter D2 with L2>2*D2 in the present embodiment.

The downstream end section 16 of the passage 12 has a much greater cross-sectional area, defined by its diameter D1, but its length L1 is much shorter than the length L2 of the upstream end section 14. The length L2 of the upstream end section 14 is about two thirds of the length of the fuel passage 12 in the present embodiment. Specifically, the following relations apply in the present embodiment:

$$D1>5*D2$$

$$L2>3*L1$$

The downstream end section 16 is arranged on its outer periphery to accommodate a ring of brazing material 18 such as copper or a brazing alloy. The upstream end section 14, the frusto-conical section 28, and the downstream end section 16 of the fuel passage 12 and the orifice 10 in the injector cup 6 are essentially coaxial, lying on a central axis 20 and the ring of brazing material 18 is also coaxial with the axis 20 of the fuel passage 12.

The large length L2 of the upstream end section 14 and its small diameter D2 effect smoothing out of fluctuations in the pressure of the fuel passing from the fuel rail 2 to the injector cup 6. The larger volume of the downstream end section 16 further enhances the smoothing function of the fuel passage (12). The upstream end of the upstream end section 14 at the inlet end 8 from the fuel rail 2 and the downstream end merging with the frusto-conical section 28 are chamfered or curved to further smooth the flow of fuel.

In some embodiments, the surface of the frusto-conical section 28 is roughened or profiled in such a way as to control the flow of the brazing material towards the narrow upstream end section 14 to limit the possibility of the brazing material blocking the upstream end section 14 during the brazing operation. Once the brazing operation is complete, the injector cup 6 is secured to the fuel rail 2 both mechanically and hydraulically fluid tightly together.

Figure 2A:
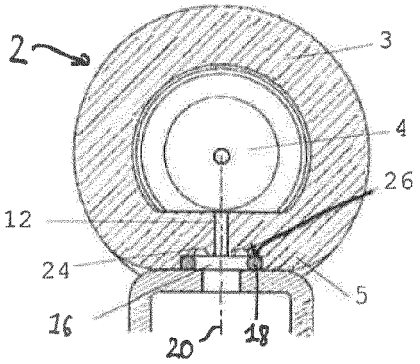
FIGS. 2A and 2B show alternative forms of a fuel passage incorporating teachings of the present disclosure.
Figure 2B:
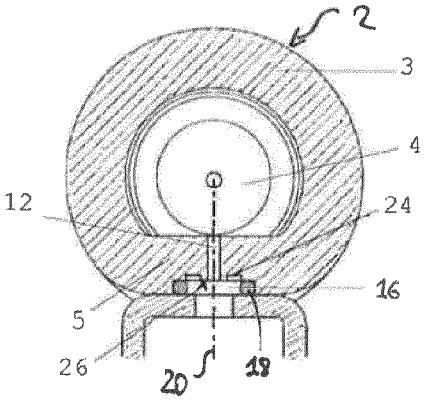

Referring now to FIGS. 2A and 2B, alternative configurations for the fuel passage 12 are shown. Otherwise, the embodiments of FIGS. 2A and 2B correspond to the first embodiment described above. Therefore, in these embodiments like components will have like references. In both figures, as in the embodiment shown in FIG. 1, the downstream end section 16 of the fuel passage 12 consists of an enlarged cylindrical section 22 having a greater diameter D2 than the upstream end section 14, giving a greater volume depending on the proportion of the respective lengths L1, L2. At its annular periphery, the downstream end section 16 is arranged to accommodate a ring of the brazing material 18.

In contrast to the embodiment of FIG. 1, the interface section between the upstream and downstream end sections is represented by a radially extending wall 26 which is generally perpendicular to the central axis 20 and extends radially outward from the outlet opening at the downstream end of the upstream end section 14.

In some embodiments, the radially extending wall 26 includes at least one annular recess forming a relief channel 24 designed to accommodate surplus brazing material during the brazing operation. The annular relief channel 24 is concentric to the central axis 20 in the present embodiment. In the example shown in FIG. 2A the relief channel 24 is arcuate in cross-section, whilst in the relief channel 24 shown in FIG. 2B the channel is of rectangular cross-section. In certain embodiments more than one such relief channel 24 may be provided and/or the surface of the radially extending wall 26 may be a roughened or profiled to control the flow of brazing material towards the outlet opening of the upstream end section 14 during the brazing process.

Although the injector cup 6 is shown as co-axial with the fuel passage 12, it is possible for the injector cup 6 to be secured to the fuel rail 2 at a point on its circumferential surface, depending upon the requirements of a particular installation.

What is claimed is:

1. A fuel rail assembly for an internal combustion engine, the fuel rail assembly comprising:

an elongate, common fuel rail having a reservoir for a fuel supply;

a plurality of adapters spaced along and fixed to a wall of the elongate, common fuel rail for hydraulically connecting a respective fuel injector to the reservoir in the elongate, common fuel rail; and a respective fuel passage associated with each adapter of the plurality of adapters, each of the fuel passages directing fuel from the reservoir to the associated adapter; wherein each of the fuel passages comprises an inlet end open to the reservoir and an upstream end section adjacent to the inlet end having a length and a cross-sectional area forming a smoothing function to smooth pressure fluctuations in fuel entering the respective fuel passages;

each of the fuel passages has a downstream end section adjacent to the associated adapter;

each of the fuel passages includes a radially extending wall perpendicular to the axis of the upstream end section and connecting a downstream end of the upstream end section with an upstream end of the downstream end section; and the radially extending wall includes an annular channel configured to provide a relief channel to absorb excess brazing material during a brazing process for fixing the respective adapter to the wall of the elongate, common fuel rail.

2. The fuel rail assembly according to claim 1, wherein each of the fuel passages comprises a respective through-hole in the wall of the elongate, common fuel rail.

3. The fuel rail assembly according to claim 2, wherein a thickness of the wall in the region of each of the fuel passages is such as to provide a length required for the fuel passage.

4. The fuel rail according to claim 1, wherein the wall is generally cylindrical and comprises a flattening comprising the fuel passage.

5. The fuel rail assembly according to claim 1, wherein:

each of the adapters comprises an injector cup adapted to receive an inlet end of the respective fuel injector; and each of the injector is mechanically secured to the wall of the elongate, common fuel rail and includes an orifice hydraulically connected to a downstream end of the respective fuel passage, remote from the inlet end of the respective fuel passages.

6. The fuel rail assembly according to claim 5, wherein each of the fuel passages is configured to accommodate a ring of brazing material at a periphery of the fuel passage through which ring of brazing material the injector cup is brazed to the elongate, common fuel rail.

7. The fuel rail assembly according to claim 1, wherein each of the downstream end sections adjacent to the associated adapters has a larger cross-sectional area than the cross-sectional area of the upstream end sections.

8. The fuel rail assembly according to claim 7, wherein each of the fuel passages comprises a frusta-conical section expanding from the upstream end section to the downstream end section.

9. The fuel rail assembly according to claim 8, wherein the frusta-conical section includes a surface profile or roughness configured to control a flow of brazing material thereacross during the brazing process.

10. The fuel rail assembly according to claim 7, wherein:

the upstream end section and the downstream end section are generally cylindrical;

the downstream end section comprises a generally cylindrical part having a larger diameter than the upstream end section.

11. The fuel rail assembly according to claim 10, wherein the radially extending wall comprises a surface profile or roughness configured to control a flow of brazing material during the brazing process.

12. The fuel rail assembly according to claim 1, wherein the radially extending wall comprises a plurality of concentrically disposed annular channels.

13. The fuel rail assembly according to claim 1, wherein the upstream end section of the fuel passage is chamfered or curved at its upstream end and/or at its downstream end.

* * * * *